US005242249A

United States Patent [19]

Grayson

[11] Patent Number: 5,242,249

[45] Date of Patent: Sep. 7, 1993

[54] PRE-CAST PANEL LIFTING INSERT

[75] Inventor: Boyd H. Grayson, Lakeland, Fla.

[73] Assignee: MMI Products, Houston, Tex.

[21] Appl. No.: 743,997

[22] Filed: Aug. 12, 1991

[51] Int. Cl.[5] ..... E02D 3/02

[52] U.S. Cl. ..... 405/286; 405/284; 52/125.4; 52/630

[58] Field of Search ..... 405/286, 284, 262, 267, 405/272, 258; 52/125.4, 126.4, 630

[56] References Cited

U.S. PATENT DOCUMENTS

| | | | |
|---|---|---|---|
| 4,449,857 | 5/1984 | Davis | 405/286 |
| 4,643,618 | 2/1987 | Hilfiker et al. | 405/284 X |
| 4,725,170 | 2/1988 | Davis | 405/284 X |
| 4,929,125 | 5/1990 | Hilfiker | 405/286 X |
| 4,992,005 | 2/1991 | Hilfiker | 405/286 X |
| 4,993,879 | 2/1991 | Hilfiker | 405/286 X |

*Primary Examiner*—Randolph A. Reese
*Assistant Examiner*—J. Russell McBee
*Attorney, Agent, or Firm*—Pettis & McDonald

[57] ABSTRACT

A panel lifting insert to be used in combination with a lifting apparatus to lift pre-cast panels and move them from one point to another. The lifting insert comprises a body with an aperture formed therein which is embedded within the pre-cast panel. Attached to the body are a pair of spaced apart legs with one end of the legs being attached to the body and the second ends being attached to one another to form a U-shaped portion. The legs are curved back upon themselves proximal to the U-shaped portion to form a hook. The hook is used to attach the lifting insert to a segment of a reinforcing means that is embedded within the panel. A lifting attachment is then connected to the aperture in the body to provide a means for connecting a lifting apparatus to the panel lifting insert and thus to the panel itself.

21 Claims, 3 Drawing Sheets

PRE-CAST PANEL LIFTING INSERT

BACKGROUND OF THE INVENTION

1. Field of the Invention.

The present invention relates to a pre-cast panel lifting insert used in combination with a lifting apparatus and a pre-cast panel, whereby the pre-cast panels may be lifted and moved from one place to another with virtually no damage from the stress of lifting. The pre-cast panels may be of any reasonable shape or size and are intended for any number of uses.

2. Description of the Prior Art.

Pre-cast panels are manufactured at a pre-cast fabrication plant or on the construction site. After curing, the panels must be lifted from the forms for shipment or for attachment to the building or other structure under construction. These panels are normally formed with their largest areas oriented in the horizontal position and are usually thin to reduce weight. Improper lifting of these panels results in cracking and failure. This is particularly true if the panels are the sandwich type; that is, comprised of a layer of insulation sandwiched between two layers of concrete. Currently, fastening devices are embedded near the surface of the top layer during the pouring process. Failure frequently occurs when the lifting insert is pulled from the surface or when the unsupported second and third layers separate from the first layer.

A device that is placed within retaining wall panels is disclosed by U.S. Pat. No. 4,449,857 that was issued to Davis. This device is used for attaching deadmen to a retaining wall panel, and may be also used during the lifting and placement process of these panels. This type of device does not distribute the load throughout the panel, which may result in failure, particularly when used with thin panels or sandwich panels.

It is clear that a device is needed to distribute the lifting load throughout the panel, particularly when the device is used with sandwich panels where it is necessary to distribute the load over the bottom layer of a panel to prevent separation of the layers.

SUMMARY OF THE INVENTION

The present invention relates to a device that is used with cranes or other lifting apparatus, to lift and move pre-cast concrete panels, particularly sandwich panels. The device is cast into the panel during the construction of the panel. The device comprises a pair of spaced apart legs, each leg having a first and a second end, the first end of each leg being attached to a body that has an aperture formed therein. The second ends of the legs are joined to one another to form a U-shaped portion. Proximal to this U-shaped portion the legs are bent back on themselves so that the legs and the U-shaped portion form a hook.

Prior to pouring the concrete, reinforcing material is placed within the pre-cast panel forms. The panel insert is then placed within the forms so that the hook of the insert engages a portion of the reinforcing material. The U-shaped portion and a segment of the reinforcing material define an opening through which a locking means is passed so that the legs of the insert are connected to the reinforcing material of the panel. If the panel is a sandwich panel, the hook engages a segment of the reinforcing material in the bottom or first layer of concrete. The insert is oriented within the panel so that access can be gained through the exterior surface of the panel to the aperture in the body. Concrete is then poured to form a first layer, the insulation placed and concrete poured to form a third layer, resulting in a sandwich panel. After curing, a lifting attachment can be connected to the body of the insert, usually by connecting it to the aperture in the body. In this manner, the load generated during lifting is passed through the lifting insert to the reinforcement in the bottom or first layer of the concrete panels.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
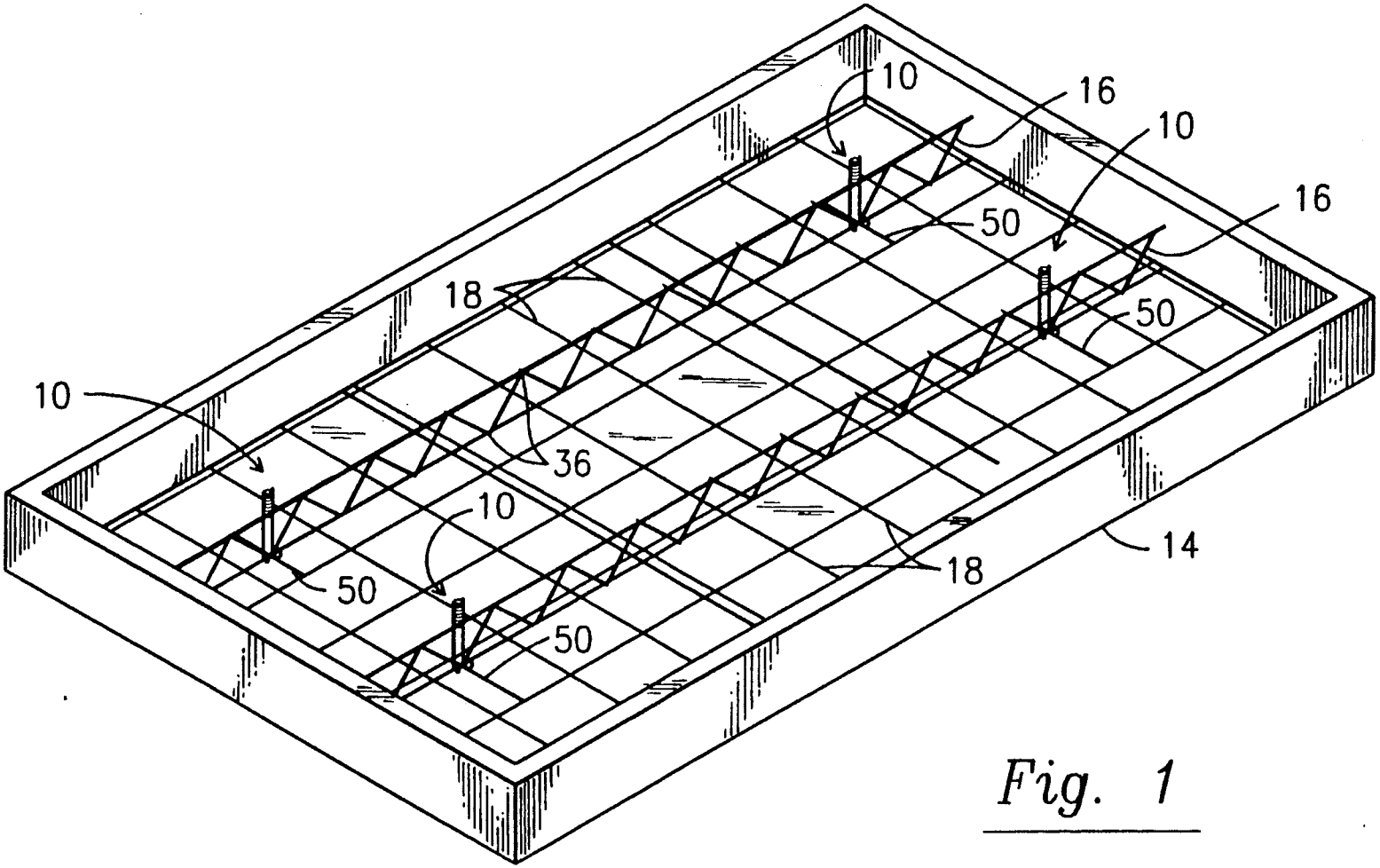
FIG. 1 is a perspective view of a typical pre-cast panel form illustrating placement of the reinforcing material and the panel lifting inserts of this invention.

A preferred embodiment for the lifting insert of this invention is illustrated in the drawing FIGS. 1–4, and is generally indicated as 10. The pre-cast panel is generally indicated as 12 in FIGS. 3 and 4, while the pre-cast panel form is indicated as 14 in FIG. 1. The reinforcing means may conveniently have the form of a truss indicated generally as 16 in FIGS. 1, 3 and 4, and reinforcing bars 18 as shown in FIG. 1.

Figure 2:
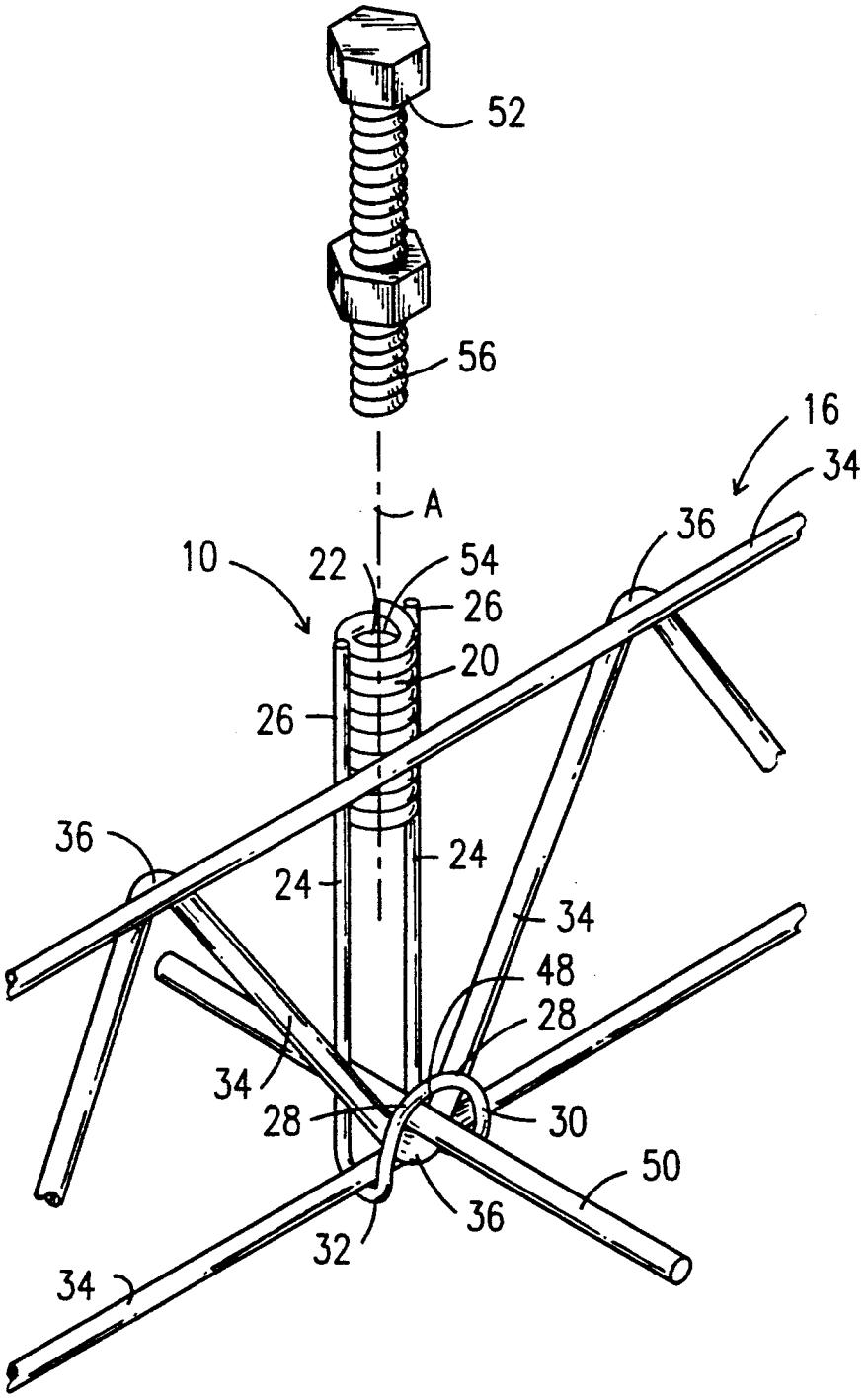
FIG. 2 is a perspective view of the lifting insert illustrating the connection of the lifting insert to a portion of the reinforcing material.
Figure 4:
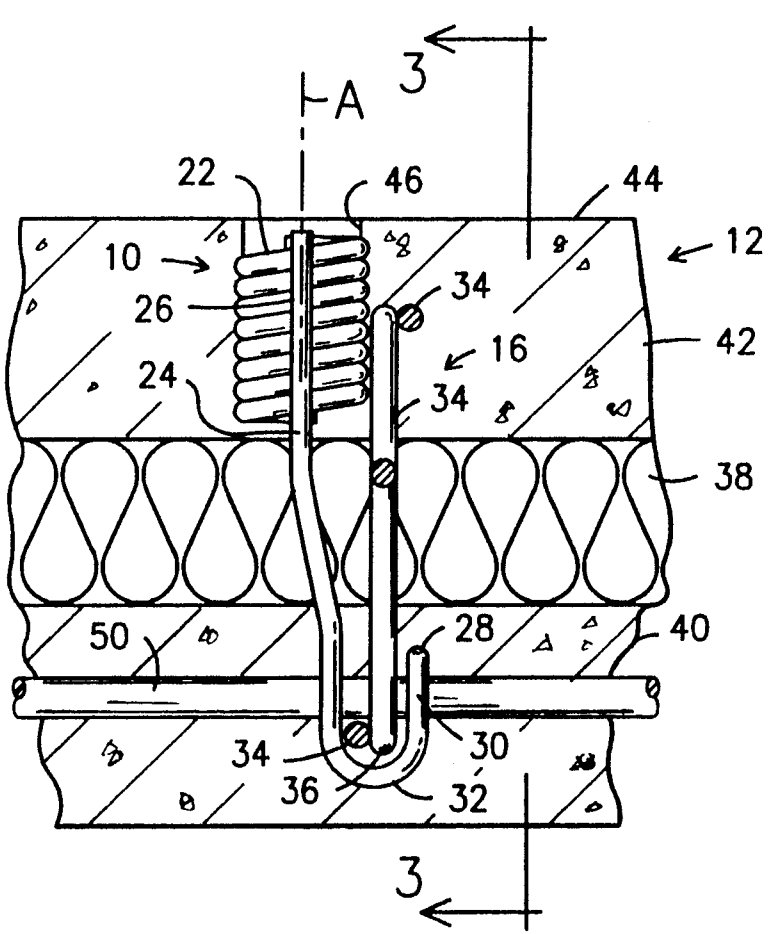
FIG. 4 is a cross sectional side elevational view taken along line 4—4 of FIG. 3 illustrating the invention within a sandwich panel.
Figure 3:
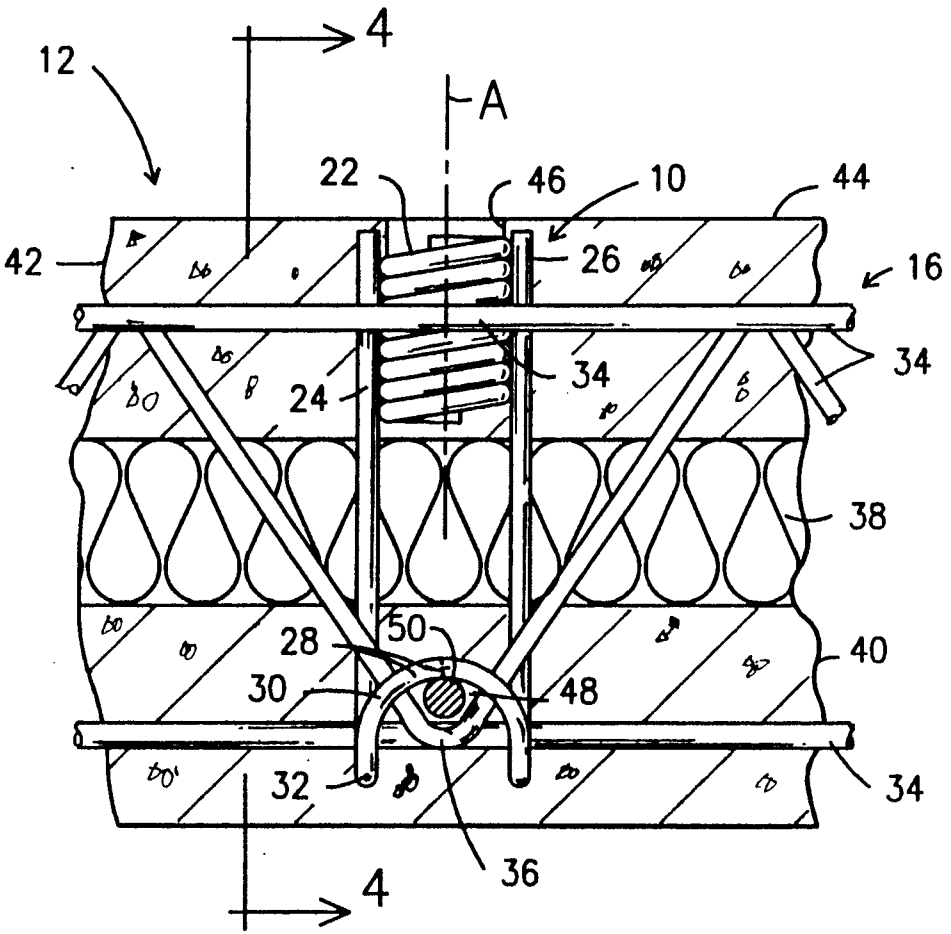
FIG. 3 is a cross sectional side elevation of the invention taken along line 3—3 of FIG. 4, illustrating the invention within a sandwich panel.

Referring first to the view of FIG. 2, it can be seen that the lifting insert 10 comprises a body 20 that has an aperture 22 formed therein. Attached to the body are a pair of spaced apart legs 24, each leg having a first end 26 and a second end 28. The first ends 26 are attached to the body 20 as by welding or other suitable means, and the second ends extend inwardly, as shown in FIGS. 3 and 4, into the panel 12. The second ends 28 are joined to form a U-shaped portion 30. The legs 24 proximal to the U-shaped portion 30 are curved back upon themselves to form a hook 32.

At least one reinforcing means, conveniently a truss 16 shown in FIGS. 1–4, is embedded within the pre-cast panel 12. In a preferred embodiment, the reinforcing means to which the lifting insert is attached is a truss 16; however, any suitable reinforcement system may be used. In a preferred embodiment of the lifting insert 10, additional reinforcement is provided in the form of reinforcing bars 18. After the reinforcing means, trusses 16 and reinforcing bars 18, have been placed in the pre-cast panel form 14, the panel lifting insert 10 is placed within the form 14 so that the hook 32 of the insert 10 engages the truss 16. The hook 32, depending on the strength of reinforcement required, may in other embodiments engage at least one of the reinforcing bars 18. The truss 16 is comprised of a number of elements 34 which meet at various junction points 36. In a preferred embodiment, for maximum support of the pre-cast panel, the hook 32 is oriented to engage a junction point 36. In a sandwich panel, a plurality of layers of at least two different materials are used. In a typical sandwich panel illustrated in FIGS. 3 and 4, the panel has three layers; a layer of insulation material 38 that is sandwiched between a first layer of concrete 40 and a second layer of concrete 42. The hook engages a junction 36 of the truss 16 within the first layer of concrete 40.

The second layer of concrete 42 has an exterior surface 44. In a preferred embodiment, the legs 24 extend toward the exterior surface 44 so that the longitudinal axis A of the aperture 22 of the body 20 is generally oriented normal to the exterior surface 44. Also, the exterior surface 44 has a hole 46 therethrough which provides access to the aperture 22 of the body 20. This results in at least a portion of the body 20 residing within the second layer of concrete 42. When the hook 32 engages a junction point 36 of the elements 34 of the truss 16, an opening 48 is defined between the U-shaped portion 30 and the adjacent elements 34 of the truss 16. A locking means, conveniently a pin 50, is inserted through the opening 48 thereby further connecting the legs 24 of the insert 10 to the truss 16. The pin 50 in the preferred embodiment remains free; however, the pin 50 may be connected to adjacent reinforcement bars 18.

The panel lifting insert further comprises a lifting attachment, conveniently a bolt and nut 52, which engages the aperture 22 and extends outwardly from the panel so that a lifting apparatus (not shown) may be removably fastened to the bolt 52 and thus to the panel 12. In other embodiments, hooks or eyes with expandable shafts or other similar devices may engage aperture 22 as the lifting attachment. In a preferred embodiment, the aperture 22 in the body 20 has internal threads 54 formed thereon and the lifting attachment 52 has external threads 56 formed thereon, so that the lifting attachment 52 may be threadably received by the threaded aperture 22 of the body 20. In a preferred embodiment, the body 20 is in the form of a rigid coil which effectively provides internal threads within the aperture 22 of the body 20. However, any suitable configuration for the body 20 may be used. The preferred material from which the lifting device is constructed is cold drawn steel wire which is then galvanized. The wire is sized according to the stresses determined through standard engineering calculations. Any of a number of suitable materials may be used as appropriate.

Having thus set forth a preferred construction for the panel lifting insert 10 of this invention, it is to be remembered that this is but a preferred embodiment. Attention is now invited to a description of the use of the panel lifting insert 10. The reinforcement trusses 16 and bars 18 are placed appropriately within the pre-cast panel form 14 in accordance with the engineering design, as shown in FIG. 1. One or more lifting inserts 10 are then placed within the form 14 at the desired lifting points, the determination of which will be dependent on the procedure and the apparatus used for the actual lift. Each lifting insert 10 is attached to a junction point 36 of the elements 34 of the truss 16 within the first layer of concrete 40. The pin 50 is then inserted through the opening 48 between the U-shaped portion 30 and a segment of the truss 16. The lifting insert 10 may then be tied with wire to the truss 16 so that the axis A of the aperture will be normal to the exterior surface 42 of the pre-cast panel 12. A plug (not shown) or the lifting attachment 52 is inserted in the aperture 22 of the body 20 prior to the pouring of concrete to insure that the aperture remains open. The first layer 40 of concrete is then poured into the form 14, insulation material 38 is then placed on the first layer 40, and finally, the second layer of concrete 42 is poured over the insulation material 38 to form the sandwich-type pre-cast panel 12. Of course, any proportions between the concrete and the insulation material may be used that is suitable for the use of the panels, and the insert 10 could be used on a solid pour (non-insulated) panel.

After the concrete has cured, the forms 14 have been removed, and the plugs have been removed from the apertures 22, the lifting attachments 52 may be inserted. The lifting attachments 52 shown in the preferred embodiment as a bolt and nut may also suitably be a threaded eye, hook or like structure for making an easy connection with a lifting apparatus. The lifting apparatus (not shown) is then attached to the lifting attachment 52 and the panel is raised and moved for shipping or for placement in the structure. The lifting insert 10, by being connected to the junction point 36, transfers the lifting load to the bottom element of the truss 16 reducing the stress within the insulation material 38 so that the layers of the pre-cast panel 12 maintain their integrity.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A panel lifting insert to be used in combination with a lifting apparatus to lift a pre-cast panel, said insert comprising:

a body embedded within said pre-cast panel, said body having an aperture formed therein and substantially embedded within said panel;

a pair of spaced apart legs attached to said body, each leg having a first end and a second end, said first ends being attached to said body such that said second ends of said legs extend inwardly into said panel, said second ends being joined to each other to form a U-shaped portion, and said legs proximal to said U-shaped portion, curving back upon themselves to form a hook; and at least one reinforcing means embedded within said panel, said reinforcing means being engaged by said hook.

2. A panel lifting insert as in claim 1 wherein an opening is defined between said U-shaped portion and a segment of said reinforcing means and wherein said panel lifting insert further comprises a locking means passing through said opening, whereby said legs are connected to said reinforcing means.

3. A panel lifting insert as in claim 2 wherein said locking means comprises a pin.

4. A panel lifting insert as in claim 1 wherein said panel lifting insert further comprises a lifting attachment engaging said aperture and extending outwardly from said panel.

5. A panel lifting insert as in claim 4 wherein said body further comprises internal threads formed in said aperture and said attachment further comprises external threads formed on a portion thereof, such that said attachment removably threadably engages said body.

6. A panel lifting insert as in claim 1 wherein said pre-cast panel further comprises an exterior surface and said aperture of said body has a longitudinal axis, said axis being oriented generally normal to said exterior surface of said panel.

7. A panel lifting insert as in claim 1 wherein said panel comprises an exterior surface having a hole therethrough such that said aperture of said body is accessible through said exterior surface.

8. A panel lifting insert as in claim 1 wherein said panel comprises a plurality of layers of at least two different materials.

9. A panel lifting insert as in claim 8 wherein said panel comprises a first layer of concrete and a second layer of concrete with a layer of insulating material interposed therebetween.

10. A panel lifting insert as in claim 9 wherein at least a part of said U-shaped portion resides in said first layer of concrete and at least a part of said body resides in said second layer of said concrete.

11. A panel lifting insert as in claim 1 wherein said reinforcing means comprises a truss formed from a plurality of elements.

12. A panel lifting insert as in claim 11 wherein said hook engages said truss at a junction of at least two of said elements of said truss.

13. A panel lifting insert as in claim 1 wherein said body is in the form of a rigid coil.

14. A panel lifting insert to be used in combination with a lifting apparatus to lift a pre-cast panel, said insert comprising:

a body embedded within said pre-cast panel, said body having an aperture formed therein;

a pair of spaced apart legs attached to said body, each leg having a first and a second end, said first ends being attached to said body such that said second ends of said legs extend inwardly into said panel, said second ends being joined to form a U-shaped portion, and said legs proximal to said U-shaped portion, curving back upon themselves to form a hook;

at least one reinforcing means embedded within said panel, said reinforcing means being engaged by said hook such that an opening is defined between said U-shaped portion and a segment of said reinforcing means; and a locking means passing through said opening, whereby said legs are connected to said reinforcing means.

15. A panel lifting insert as in claim 14 wherein said locking means comprises a pin.

16. A panel lifting insert to be used in combination with a lifting apparatus to lift a pre-cast panel, said insert comprising:

a body embedded within said pre-cast panel, said body having an aperture formed therein and said panel having an exterior surface, said exterior surface of said panel having a hole therethrough such that said aperture of said body is accessible through said exterior surface;

a pair of spaced apart legs attached to said body, each leg having a first end and a second end, said first ends being attached to said body such that said second ends of said legs extend inwardly into said panel, said second ends being joined to form a U-shaped portion, and said legs proximal to said U-shaped portion, curving back upon themselves to form a hook;

at least one reinforcing means embedded within said panel, said reinforcing means being engaged by said hook; and a lifting attachment engaging said aperture and extending outwardly from said panel.

17. A panel lifting insert as in claim 16 wherein said body further comprises internal threads formed in said aperture and said attachment further comprises external threads formed on a portion thereof such that said attachment removably and threadably engages said body.

18. A panel lifting insert in combination with a lifting apparatus and a pre-cast panel, comprising:

a pre-cast panel comprising at least two layers of concrete and at least one layer of insulating material interposed between said layers of concrete;

a body embedded within said pre-cast panel, said body having an aperture formed therein;

a pair of spaced apart legs attached to said body, each leg having a first end and a second end, said first ends being attached to said body such that said second ends of said legs extend inwardly into said panel, said second ends being joined to form a U-shaped portion, and said legs proximal to said U-shaped portion, curving back upon themselves to form a hook; and at least one reinforcing means embedded within said panel, said reinforcing means being engaged by said hook.

19. A panel lifting insert as in claim 18 wherein said panel comprises a first layer of concrete and a second layer of concrete with said layer of insulating material interposed therebetween, and wherein at least a part of said U-shaped portion of said legs resides in said first layer of concrete and at least a part of said body resides in said second layer of said concrete.

20. A panel lifting insert to be used in combination with a lifting apparatus to lift a pre-cast panel, said insert comprising:

a body embedded within said pre-cast panel, said body having an aperture formed therein;

a pair of spaced apart legs attached to said body, each leg having a first end and a second end, said first ends being attached to said body such that said second ends of said legs extend inwardly into said panel, said second ends being joined to form a U-shaped portion, and said legs proximal to said U-shaped portion, curving back upon themselves to form a hook; and a reinforcing means comprising a truss formed from a plurality of elements, said truss being embedded within said panel, said hook of said legs engaging said truss at a junction of at least two of said elements of said truss.

21. A panel lifting insert to be used in combination with a lifting apparatus to lift a pre-cast panel, said insert comprising:

a body formed in the shape of a rigid coil, said body having an aperture formed therein;

a pair of spaced apart legs attached to said body, each leg having a first end and a second end, said first ends being attached to said body such that said second ends of said legs extend outward from said body, said second ends being joined to form a U-shaped portion, and said legs proximal to said U-shaped portion, curving back upon themselves to form a hook.

* * * * *